US006935083B2

(12) United States Patent
Chezum

(10) Patent No.: US 6,935,083 B2
(45) Date of Patent: Aug. 30, 2005

(54) SKIRTING FOR MANUFACTURED AND MODULAR HOMES

(76) Inventor: C. Michael Chezum, 2828 - 110th Ave., Viola, IL (US) 61486

( * ) Notice: Subject to any disclaimer, the term of this patent is extended or adjusted under 35 U.S.C. 154(b) by 87 days.

(21) Appl. No.: 10/192,946

(22) Filed: Jul. 11, 2002

(65) Prior Publication Data

US 2004/0006936 A1 Jan. 15, 2004

(51) Int. Cl.[7] ..... E04B 2/90; E04B 2/08

(52) U.S. Cl. ..... 52/511; 52/506.08; 52/512; 52/597; 52/391; 52/489.1

(58) Field of Search ..... 52/391, 506.08, 52/235, 511, 598, 512, 597, 489.1, 169.12, DIG. 3, 278, 282.3, 282.4, 251, 250, 506.05, 506.06, 274

(56) References Cited

U.S. PATENT DOCUMENTS

| | | | | | |
|---|---|---|---|---|---|
| 1,052,670 | A | * | 2/1913 | Francis | 52/509 |
| 1,988,147 | A | * | 1/1935 | Voigt | 52/506.09 |
| 2,316,660 | A | * | 4/1943 | Bailey | 52/274 |
| 3,159,368 | A | * | 12/1964 | Ahlbin et al. | 248/222.41 |
| 3,181,662 | A | * | 5/1965 | Maertzig, Jr. | 52/509 |
| 3,264,793 | A | * | 8/1966 | Schlensker | 52/511 |
| 3,342,005 | A | * | 9/1967 | Rickards et al. | 52/702 |
| 3,350,830 | A | * | 11/1967 | Smith, Jr. et al. | 52/509 |
| 3,471,982 | A | * | 10/1969 | Strozewski | 52/282.4 |
| 3,478,480 | A | * | 11/1969 | Swenson | 52/396.05 |
| 3,561,175 | A | | 2/1971 | Best et al. | |
| 3,608,928 | A | | 9/1971 | Hooker | |
| 3,775,917 | A | * | 12/1973 | Struben | 52/169.12 |
| 3,803,781 | A | * | 4/1974 | Struben | 52/149 |
| 3,888,055 | A | * | 6/1975 | Gallo | 52/98 |
| 3,956,859 | A | | 5/1976 | Ingestrom | |
| 4,060,951 | A | * | 12/1977 | Gere | 52/508 |
| 4,074,486 | A | * | 2/1978 | Grearson | 52/235 |
| 4,107,887 | A | * | 8/1978 | Wendt | 52/105 |
| 4,145,861 | A | | 3/1979 | Yarnick | |
| 4,199,907 | A | * | 4/1980 | Bains et al. | 52/122.1 |
| 4,214,412 | A | | 7/1980 | Barylski | |
| 4,250,678 | A | * | 2/1981 | Skuran | 52/478 |
| 4,290,246 | A | | 9/1981 | Hilsey | |
| 4,335,548 | A | | 6/1982 | Rehbein | |
| 4,352,261 | A | * | 10/1982 | Wargo | 52/169.12 |
| 4,422,275 | A | * | 12/1983 | Baetje | 52/509 |
| 4,439,960 | A | * | 4/1984 | Jenkins | 52/99 |
| 4,502,656 | A | * | 3/1985 | Zeitler | 248/346.03 |
| 4,549,378 | A | | 10/1985 | Ayers et al. | |
| 4,603,829 | A | * | 8/1986 | Koike et al. | 248/553 |
| 4,656,797 | A | * | 4/1987 | Marquart | 52/169.12 |
| 4,694,625 | A | | 9/1987 | Gregory | |
| 4,738,061 | A | | 4/1988 | Herndon | |

(Continued)

FOREIGN PATENT DOCUMENTS

| | | | | |
|---|---|---|---|---|
| EP | 191709 | * | 8/1986 | 52/506.05 |
| EP | 450776 | * | 10/1991 | 52/506.05 |
| JP | 405018088 | * | 1/1993 | 52/506.05 |
| WO | 88/03204 | * | 5/1988 | 52/509 |

*Primary Examiner*—Lanna Mai
*Assistant Examiner*—Phi Dieu Tran A
(74) *Attorney, Agent, or Firm*—Daniel A. Rosenberg; Kent A. Herink; Emily E. Harris

(57) ABSTRACT

A skirting system for placement around a manufactured or modular home is provided wherein said system comprises a plurality of panels with upper and lower ends wherein the panels abut each other side to side to form a perimeter around the home. A plurality of base pads are provided and placed on the ground for supporting the lower ends of the panels. A plurality of two part channel clips are provided for securing the upper ends of the panels to the home in a manner that allows for vertical movement but provides for substantial support of the panels in a direction transverse to the length of the panels.

9 Claims, 7 Drawing Sheets

U.S. PATENT DOCUMENTS 4,765,111 A * 8/1988 Osawa ..... 52/509
4,776,143 A * 10/1988 Pointner ..... 52/506.08
4,805,361 A * 2/1989 Mason et al. ..... 52/169.12
5,138,809 A * 8/1992 Saikachi ..... 52/235
5,193,714 A 3/1993 Carey
5,216,860 A * 6/1993 Thomson et al. ..... 52/259
5,239,798 A * 8/1993 Saito ..... 52/235
5,265,396 A * 11/1993 Amimoto ..... 52/745.12
5,283,992 A * 2/1994 Morassutti ..... 52/509
5,335,472 A * 8/1994 Phillips ..... 52/742.14
5,359,816 A 11/1994 Iacouides
5,363,620 A * 11/1994 Liu ..... 52/482
5,367,845 A 11/1994 Hartling
5,399,050 A * 3/1995 Jacobus ..... 405/229
5,417,050 A * 5/1995 Cosentino ..... 52/506.08
5,471,811 A * 12/1995 House et al. ..... 52/745.1
5,511,350 A 4/1996 Nivens
5,535,556 A * 7/1996 Hughes, Jr. ..... 52/169.5
5,544,461 A * 8/1996 Sommerstein ..... 52/235
5,611,179 A * 3/1997 Leek ..... 52/293.3
5,704,172 A 1/1998 Gougeon et al.
5,749,182 A * 5/1998 Vavrinak ..... 52/169.14
5,987,827 A * 11/1999 Lord ..... 52/274
6,098,364 A * 8/2000 Liu ..... 52/506.08
6,125,597 A 10/2000 Hoffman et al.
6,145,803 A * 11/2000 Emody et al. ..... 248/674
6,247,276 B1 * 6/2001 Masters et al. ..... 52/169.12
6,374,552 B1 * 4/2002 Price ..... 52/169.12
6,443,666 B1 * 9/2002 Smith ..... 405/286
6,578,148 B1 * 6/2003 Beuchat et al. ..... 713/200

* cited by examiner

Fig. 3
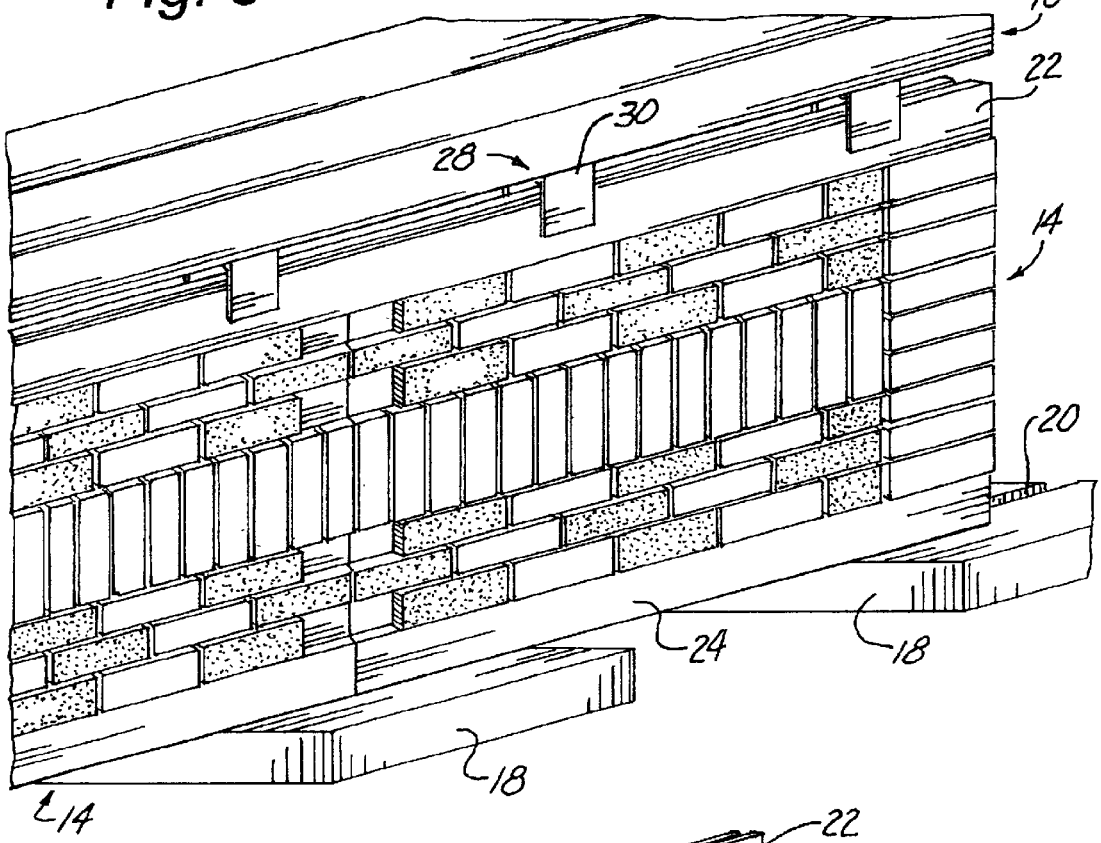
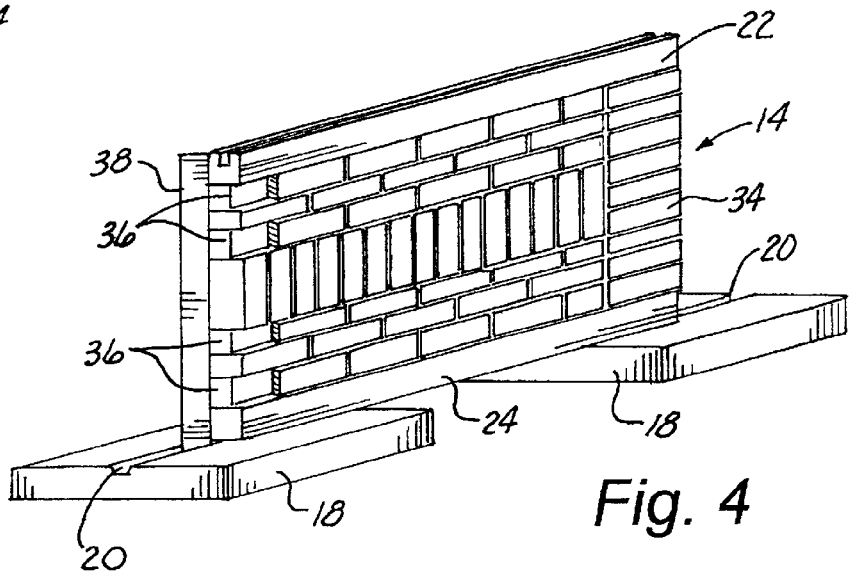
Fig. 4

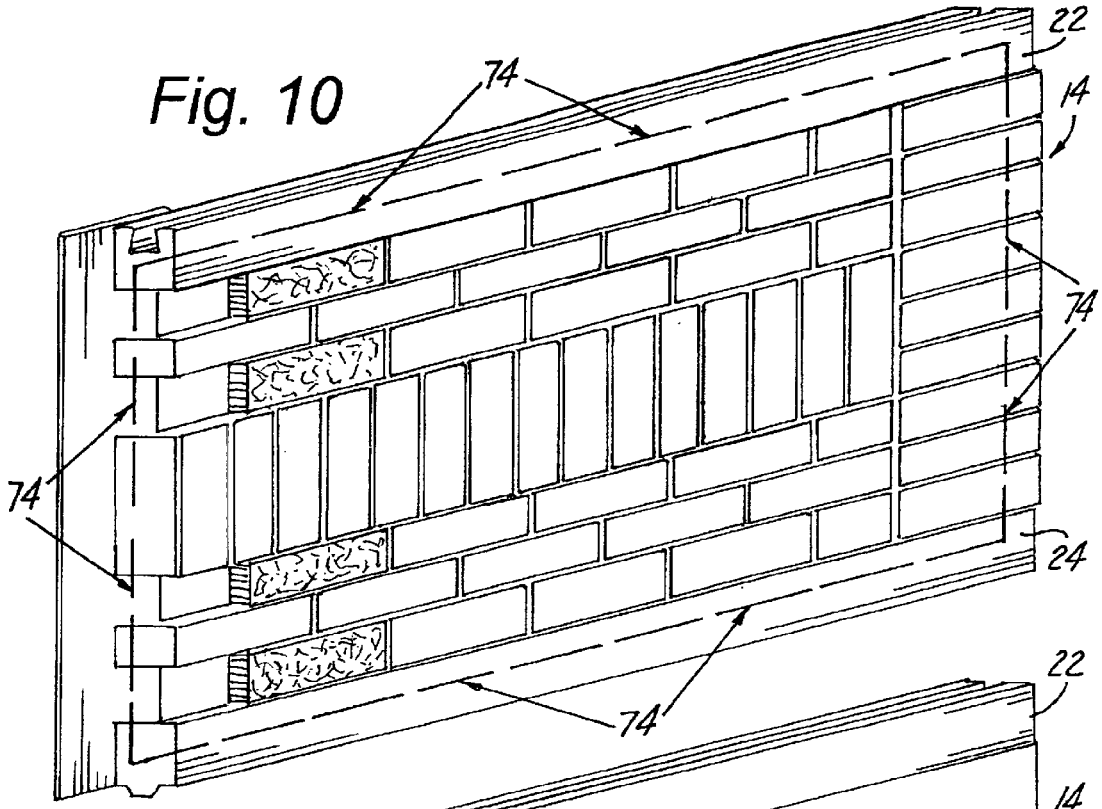
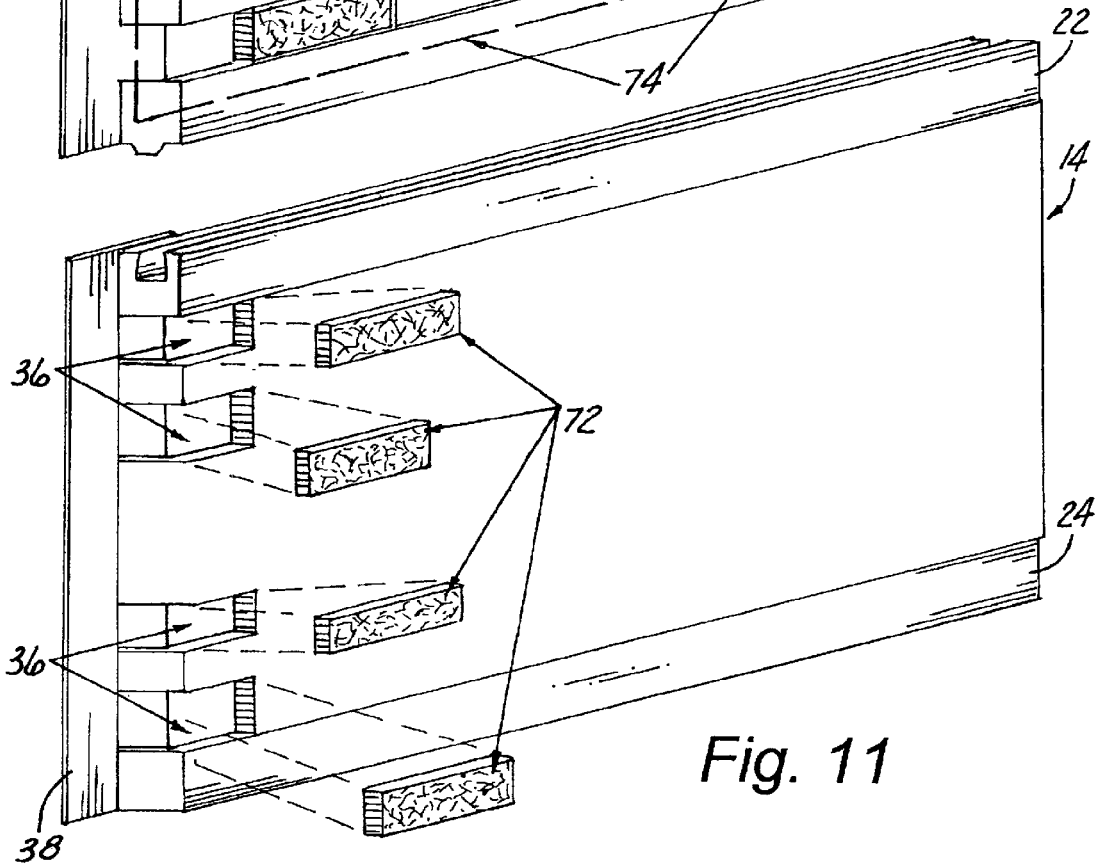
Fig. 11

SKIRTING FOR MANUFACTURED AND MODULAR HOMES

BACKGROUND OF THE INVENTION

The present invention relates to a skirting system for manufactured and modular homes. In particular, to a skirting system comprised of a plurality of abutting panels set on top of base pads and retained by two channel clips.

Manufactured and modular homes differ from site built homes in that the former do not need a continuous below grade perimeter foundation. Instead, manufactured and modular homes are typically prefabricated at a remote site and then affixed to a generally above ground foundation, or are placed on frost piers that extend below grade, or are placed on block piers that are placed on base pads. In any case, some type of skirting masks the transition between the foundation and the home. The skirting hides the underside of the home and the foundation, and provides an element of security and safety in that it prevents access to the underside of the home to both animals and potential intruders. Typically, the skirting comprises vinyl panels or sheets staked to the ground and wedged or otherwise tied to the side of the home.

While widely used, vinyl skirting suffers from a number of drawbacks. Vinyl skirting lacks durability. In high winds vinyl skirting tends to easily detach and leave the underside of the home unprotected. Vinyl skirting is also easily damaged, dented, or torn and does not hold up well to the type of impact that routinely occurs from children playing around the home or from pets. Another disadvantage of vinyl skirting is that due to the ease of removal it provides little security and does little to prevent wild animals from gaining access to the underside of the home. Finally, vinyl skirting is widely disliked for its lack of aesthetic appeal and is commonly associated negatively in the minds of many with mobile homes.

In recent times advancements in the technology of manufactured and modular homes has resulted in the development of homes that rival site built homes in appearance and quality. However, without a durable and aesthetically pleasing skirting these types of homes still suffer from the stigma associated with lower level homes. Efforts to deal with this problem have resulted in the development of more durable skirting systems that attempt to duplicate the look and feel of the foundation of a site built home. While solving some of the problems associated with early skirting systems, these systems tend to be difficult to install and cumbersome to manipulate.

In certain instances, however, some manufactured and modular homes are placed on perimeter foundations. These foundations typically comprise some sort of a concrete footing placed sufficiently below grade to avoid the affects of frost heave. A base is then used to avoid problems with settlement, and then a foundation wall that will support the home is placed on the base. The foundation wall may include a brick ledge at grade level to accommodate the incorporation of a decorative brick veneer on the outer surface of the foundation wall. While foundations of these types can add to the aesthetic appearance of the home, especially compared to vinyl skirting, and can accommodate for vertical movement caused by frost heave and settlement, they still suffer from a number of drawbacks.

In particular, these foundations substantially increase the cost of the home because of the need for extensive excavation around the perimeter of the home, and due to the cost of constructing the foundation. Even with the more extensive foundation, homes of this type may still fail to meet the standards of some housing community's restrictive covenants and ordinances. Additionally, the upgrade in the quality of the foundation may result in the application of a higher tax on the home.

Accordingly, a need exists for an improved skirting system for use with manufactured and modular homes that is durable, easy to install, and duplicates the look and feel of the foundation of a site built home, without the need for an extensive continuous below grade perimeter foundation.

SUMMARY OF THE INVENTION

An object of the present invention comprises providing a skirting system for placement around a manufactured or modular home that substantially duplicates the look, feel, and durability of the foundation of a site built home.

These and other objects of the present invention will become apparent to those skilled in the art upon reference to the following specification, drawings, and claims.

The present invention intends to overcome the difficulties encountered heretofore. To that end, a skirting system for placement around a manufactured or modular home is provided wherein said system comprises a plurality of panels with upper and lower ends wherein the panels abut each other side to side to form a perimeter around the home. A plurality of base pads are provided and placed on the ground for supporting the lower ends of the panels. A plurality of two part channel clips are provided for securing the upper ends of the panels to the home in a manner that allows for vertical movement but provides for substantial support of the panels in a direction transverse to the length of the panels.

BRIEF DESCRIPTION OF THE DRAWINGS

FIG. 3 is a perspective view of the two panels with the trim board and backfilled dirt removed.

FIG. 4 is a perspective view of a panel and base pads of the skirting system.

FIG. 10 is a perspective view of a panel showing the internal reinforced framework of the panel.

FIG. 11 is a perspective view of a portion of panel showing recess brick areas and corresponding cover bricks inserts.

DETAILED DESCRIPTION OF THE INVENTION

Figure 1:
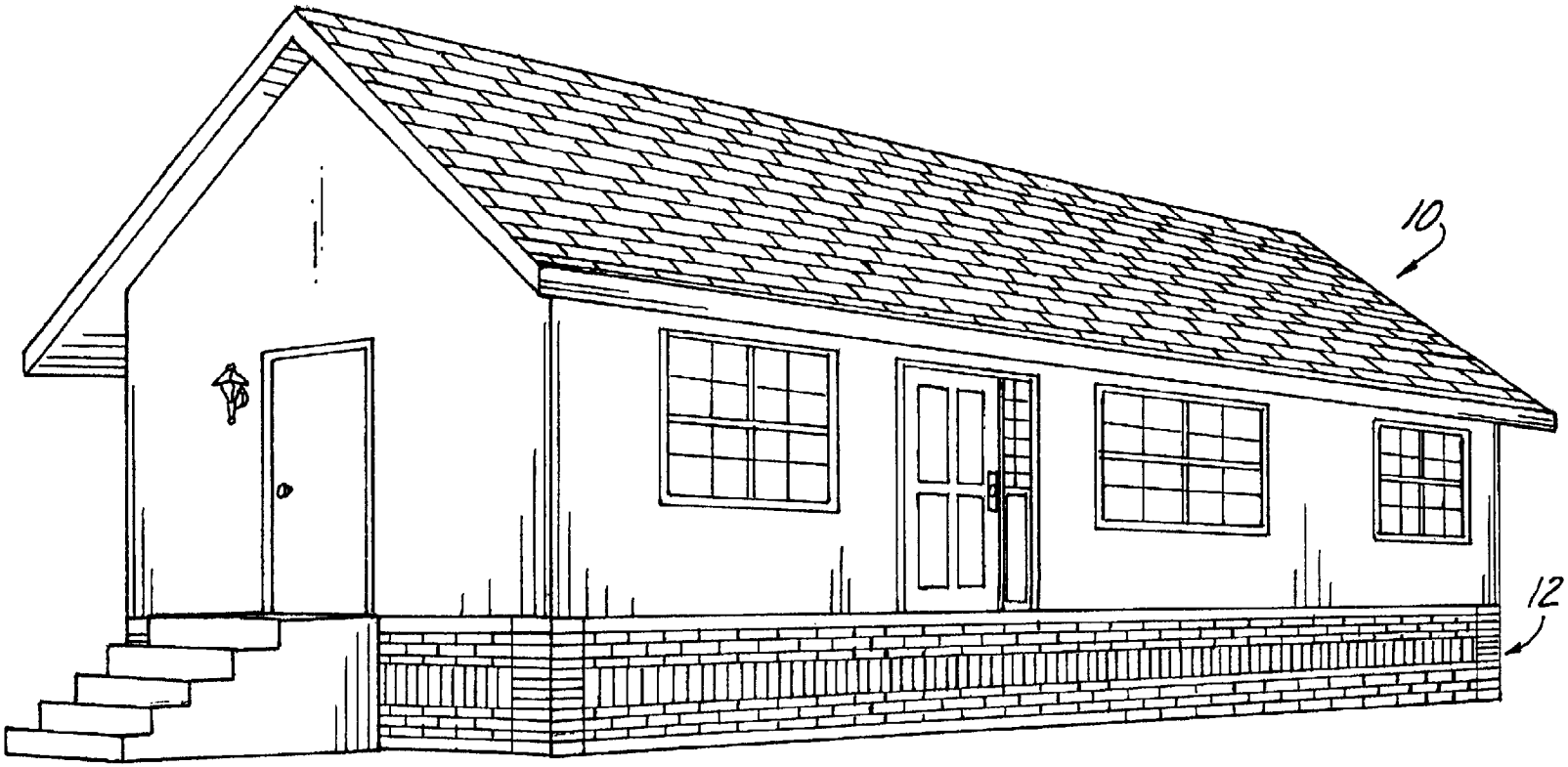
FIG. 1 is a perspective view of a home with the skirting system of the present invention installed thereto.
Figure 2:
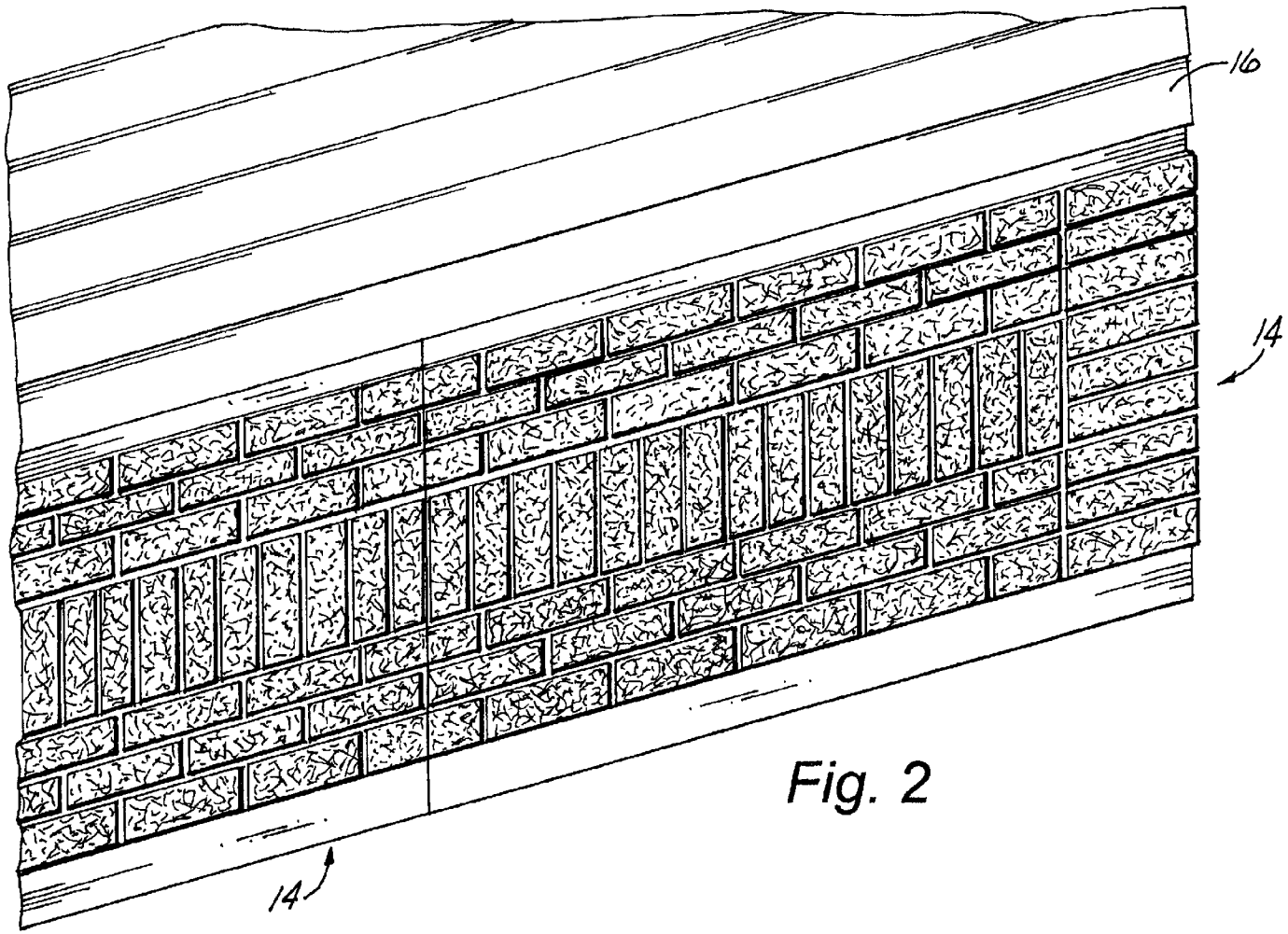
FIG. 2 is a perspective view of two panels of the skirting system installed.

In the Figures, FIG. 1 shows a home 10 of the type for which the present invention is designed for use. FIG. 2 shows in greater detail the finished look of a portion of a skirting system 12 placed around the home 10 shown in FIG.

1. The home 10 is of the manufactured or modular type and is prefabricated for placement above a foundation. This arrangement, however, in unfinished form leaves a gap between the bottom of the home 10 and the ground, and for this reason the area between the bottom of the home 10 and the ground is surrounded by the skirting system 12. The skirting system 12 is comprised of a plurality of abutting panels 14, which duplicate the aesthetic look and feel of a foundation of a site built home. The panels 14 are attached to the underside of the home 10 with connecting elements in a manner that allows for sufficient vertical movement to accommodate for frost heave and settlement, and the panels 14 are set to the ground just below grade to allow for backfilling against the outside bottom portion of the panels 14. This allows the panels to move up and down but prevents any other type of movement and conceals elements of the panels 14 and connecting securement elements such that the visible portion of the panel 14 looks like the foundation of a site built home.

In the preferred embodiment of the invention the panels 14 are constructed of a reinforced concrete frame to provide for strength and durability and to support a full brick interior facade to duplicate the look and feel of the foundation of a site built home. Of course, those of ordinary skill in the art will appreciate the fact that the panels 14 can and will vary in composition and aesthetic appearance without departing from the scope of the present invention.

In particular, FIG. 3 shows essentially the same portion of the skirting system 10 depicted in FIG. 2, except with a trim board 16 and dirt above grade removed to better show the connecting elements. The skirting system 10 includes a plurality of panels 14 that abut along a nearly invisible seam between the panels 14. The panels 14 are set on top of base pads 18, wherein each pair of panels 14 are preferably set on a portion of one base pads 18. The base pads 18 are also constructed of concrete for durability and strength. The base pads 18 include a centrally located slot 20 that runs horizontally across the top of the base pads 18. The slot 20 forms a groove to receive the bottom edge of the panel 14. The bottom portion of the panel 14 includes an extended tab 26 that inserts into the slot 20 of the base pads 18. In this manner, the slot 20 secures the bottom of the panel 14 from movement in a direction transverse to the length of the panel 14. Secured in this manner the panel 14 can sufficiently resist the force of backfilled dirt that will cover the base pads 18 and the bottom edge of the panel 14.

The upper edge of the panel 14 is secured by a double clip channel 28, which is comprised principally of a front clip 30 and a slotted back clip 32. As disclosed in greater detail hereinbelow, the double clip channel 28 comprises the element that connects the panels 14 to the home 10 in a manner that allows for adequate vertical movement to accommodate frost heave and settlement, but still prevent movement in a direction transverse to the length of the panel 14. Furthermore, the two piece construction of the double clip channel 28 also allows for easy installation of the panels 14.

As can be seen in FIGS. 3, and 10, the panel 14 on the end differs slightly from the interior panels that abut each other. The end panel includes on one side a row 34 of vertically elongated bricks, while the other end includes bricks in a variety of shapes and orientations including upper and lower recessed brick areas 36 with horizontally elongated bricks therebetween. The other panel 14 shown in FIG. 3 includes the recessed brick areas 36 arrangement on each side of the panel 14. Thus, one panel 14 is suited for a corner while the other panel 14 forms an interior abutting panel 14. The recessed brick areas 36 allow for a smooth abutment between the panels 14 and helps to create a nearly invisible seam therebetween by hiding the appearance of the seam. In particular, the recessed brick areas 36 are designed to receive a thin layer brick insert 72 that will span the seam between the abutting panels 14. In this manner the seam is hidden from view thereby duplicating the look of the foundation of a site built home. The inserts 72 are secured with a flexible adhesive that will resist cracking as the panels 14 move slightly over time. The inserts 72 can include spacing tabs along the perimeter to temporarily hold the inserts 72 in place with spring-like tension against the edge of the adjoining bricks.

FIG. 4 shows a single panel 14 placed on top of two slotted base pads 18, and shows that the joint between panels 14 is reinforced with an integral steel back plate 38. This provides additional strength and reinforcement between panels 14 to resist movement in a direction transverse to the length of the panels 14.

The panels 14 themselves are comprised of an upper beam 22 and a lower beam 24 both of which include reinforcement in the form of rebar 74 integrated into the concrete for added strength at the panel 14 upper and lower connecting points. In addition, the sides of the panels 14 also include rebar 74 that run through holes in the interior of the bricks along the sides of the panels 14. The combination of the reinforced upper and lower beams 22, 24 and the addition of side reinforcement creates a reinforced frame around the exterior of the panels 14 that can support a full brick interior. In other words, the remainder of the panel 14 is comprised of full brick construction that can take on a variety of looks to achieve the desired aesthetic effect. The arrangement of the bricks shown in the Figures is merely exemplary, and those of ordinary skill in the art will understand that the pattern can and will vary depending on the specific application and desired effect without departing from the scope of the intended invention. Again, in the preferred embodiment the panels 14 duplicate the look of a site built foundation by allowing for the incorporation of full brick construction, or of any other suitable exterior material like stone and the like. In prior art designs the use of full brick in panels was not possible due to the fact that the panel lacked sufficient reinforcement to support such a construction. In some prior art designs the use of continuous reinforced backing was required to support even a brick veneer. The frame created by the rebar and upper lower beams 22, 24 in the panels 14 of the present invention provides sufficient internal support and strength to support an internal construction of brick, stone, or the like. The advantage of such a feature is readily apparent in that the finished look of the skirting system 10 of the present invention is virtually in distinguishable from a site built home, but can be installed and constructed in a much more efficient and cost effect manner relative to the prior art. The look of the top and bottom beams 22, 24 is not critical due to the fact that they will be hidden from view after completion of the installation of the skirting system 10.

Figure 5:
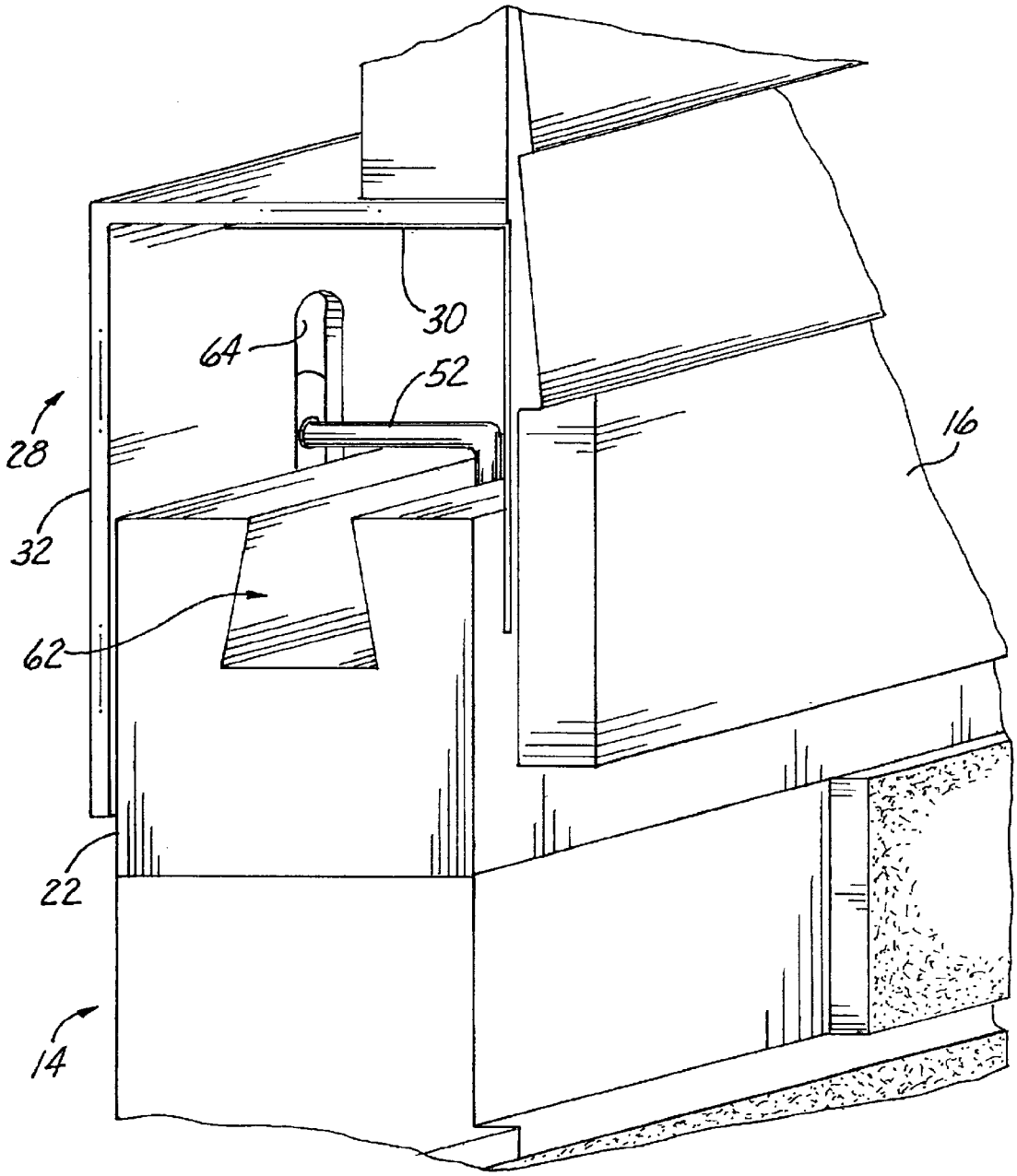
FIG. 5 is a perspective cross sectional view of an upper connecting element of the skirting system.
Figure 6:
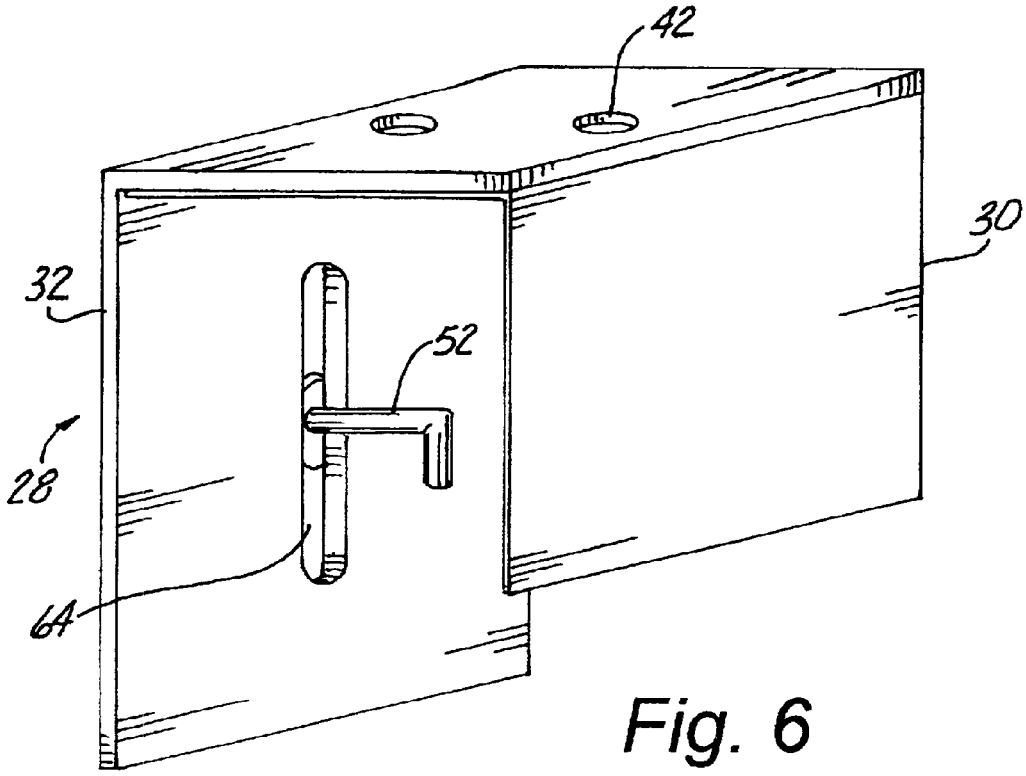
FIG. 6 is a perspective view of a double clip channel of the upper connecting element of the skirting system.
Figure 7:
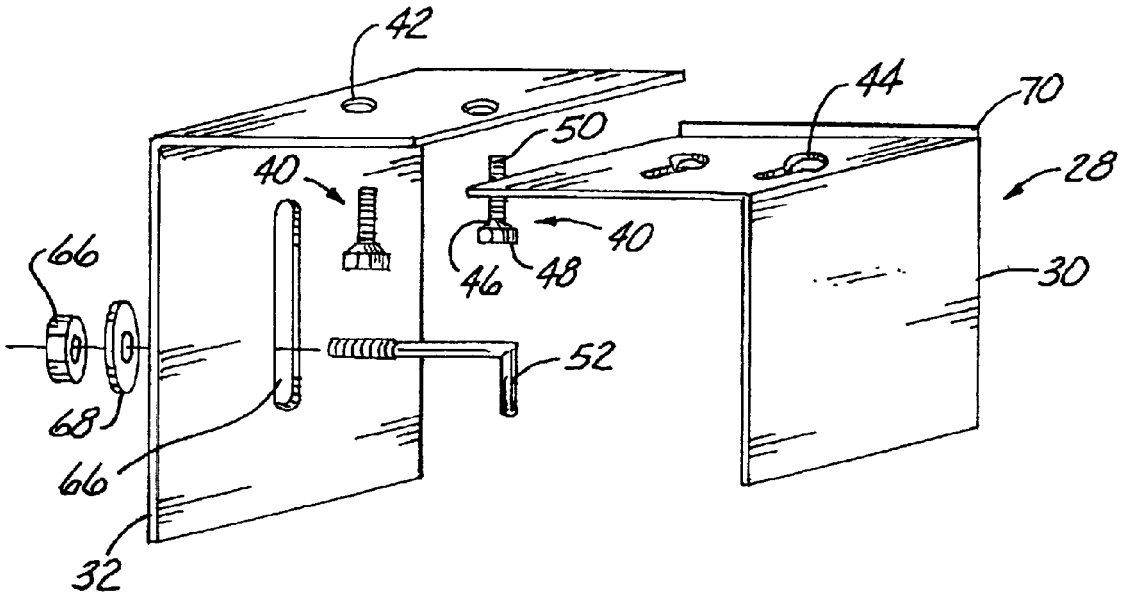
FIG. 7 is an exploded view of the double clip channel.

FIGS. 5–7 show a detailed view of the top of the panel 14 and the two part double clip channel 28. As mentioned hereinabove, double clip channel 28 comprises a front clip 30 and a slotted clip 32. The slotted clip 32 secures to the outer underside of the home 10 with bolts 40 that align through holes 42 in the slotted clip. The front clip 30 secures to the slotted clip 32 through keyhole slots 44 that align to the bolts 42 that secure the slotted clip 32 to the home 10. The bolts 42 include a spacer 46 between a threaded portion 50 and a bolt head 48. Alternatively, a shouldered bolt can be used. The bolt head 48 is narrower than the wide part of the keyhole slot 44, but the bolt head 48 is wider than the narrow portion of the keyhole slot 44. As can be seen this allows for easy assembly of the double clip channel 28 without sacrificing securement. An anchor bolt 52 secures through a slot 64 in the slotted clip and is secured with a nut 66 and washer 68. The anchor bolt 52 is L-shaped and at its end protrudes downward into a dove-tail anchor slot 62 in the upper beam 22 of the panel 14.

The following procedure describes the method of assembly of the double clip channel 28 and panel 14. The first step comprises securing the slotted clip 32 to the underside of the home 10. This is accomplished by inserting the bolts 40 through the bolt hole 42 in the slotted clip 32 and then securing the bolts 40. The panel 14 is then placed on the base pads 18 and can lean against the slotted clip 32 for support. Due to the fact that the panels 14 are substantial in weight, the ability to freely move the panels 14 into place with only the slotted clip 32 in place greatly reduces the difficulty of installation by eliminating the need to move the panels 14 after initial placement on the base pads 18. The anchor bolt 52 is inserted into the dove-tail anchor slot 62 of the upper beam 22 of the panel 14, and then secured with the nut 66 and washer 68 within the slot 64 in the slotted clip 32. This helps to stabilize the panel 14. The front clip 30 is installed next by placing the wide end of the key hole slots 44 over the head 48 of the installed bolts 40 that hold the slotted clip 32 to the underside of the home. The front clip 30 slides over such that the heads 48 of the bolts 40 are captured by the narrow end of the keyhole slots 44. Also, the front clip 30 includes a raised lip 70 that engages the side of the slotted clip 32 thereby locking the clips 30, 32 in place and preventing lateral movement.

In this manner, the panels 14 are allowed to move vertically to accommodate frost heave and settlement, but are otherwise held rigidly in place. The skirting system 10 allows for back filling against the panels 14 without risk of damaging or displacing the panels 14 because of the quality of the secure connection between the panels 14, base pads 18, and double clip channel 28. Backfilling hides from view the base pads 18 and the lower beam 24. A trim board 16 placed around the perimeter of the home 10 hides the front clip 30 and the upper beam 22. Thus, the skirting system 10 provides a substantial skirting that both resists the forces that can damage skirting over time, and provides an aesthetically pleasing appearance that duplicates the look and feel of the permanent foundation of site built home. In addition, as mentioned hereinabove the panels 14 utilize a reinforced frame that allows for the inclusion of a full brick interior, or an interior of any other suitable material. This allows the panels 14 to essentially duplicate the look of a site built foundation or of a continuous perimeter below grade foundation, but without the cost of material associated with such foundations and without the need for the excavation required for the same while at the same time simplifying installation.

Figure 8:
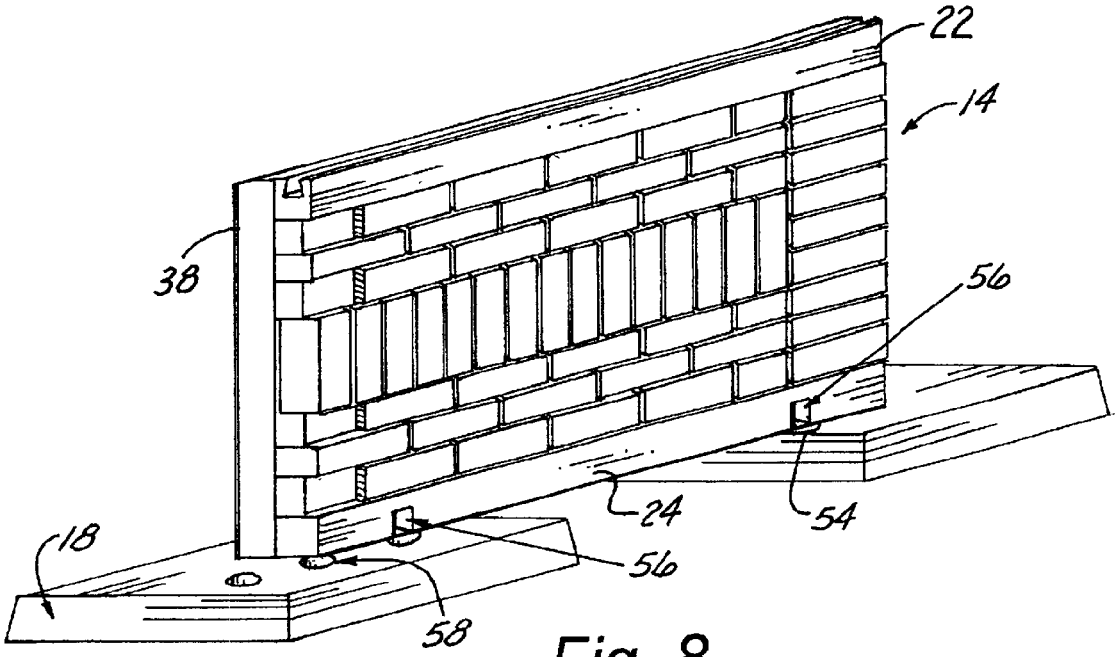
FIG. 8 is a perspective view of an alternative panel and base pad.
Figure 9:
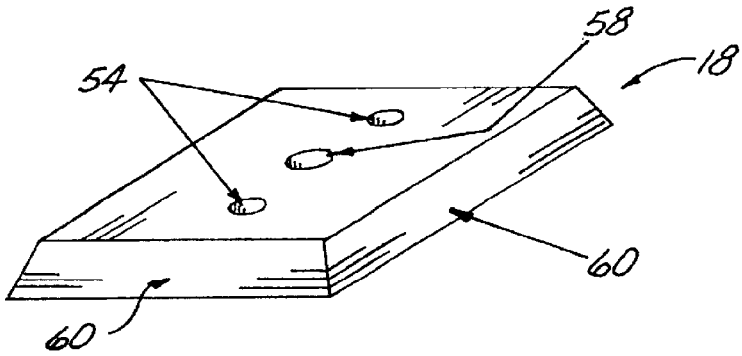
FIG. 9 is a perspective view of the alternative base pad.

FIGS. 8–9 show an alternative embodiment of the skirting system 10. The base pads 18 of the alternative embodiment replace the slot 20 with a plurality of holes 54, 60. Preferably, the base pads 18 include three holes along that center line of the base pad. The outer two holes 54 allow for insertion of anchor pins (not shown) through anchor pin slots 56 positioned at the lower ends of the panels 14. Thus, each base pad 18 supports the edge of two panels 14, and anchor pins are inserted through anchor pin slots 56 in each of the abutting panels 14. This embodiment eliminates the need for the extended tab 26 on the bottom panels 14 and the slot 20 in the base pads 18. This arrangement provides for more flexibility in placement of the base pads 18 and for an easier alignment of the base pads 18 and the panels 14. In some installations balancing the panels 14 on the base pads 18 can prove troublesome. Furthermore, the slot 20 and tab 26 embodiment generally requires more precise placement of the base pads 18 to allow for the tab 26 to fill into the slot 20 along the length of the base pads 18. Also, the use of the anchor pins provides for additional securement of the base pads 18 to the ground, while also allowing for securement of the panels 14 to the base pads 18 by inserting the anchor pins through the slots 54, 56 in the panel 14 and base pads 18.

Additionally, as seen in FIG. 9 the sides 60 of the base pads 18 are tapered for the purpose of making them easier to remove from the base pad forms during fabrication.

A further additional element of the alternative embodiment comprises the addition of a center alignment hole 58, which facilitates the overall placement of the base pads 18 and subsequent placement of the panels 14. In particular, at each corner of the home 10 a point is established by plumbing down from each corner. These comer points will subsequently be used to set the placement of the base pads 18 and to establish grade level. A stake (not shown) is driven at each corner to a level such that the top of each comer stake corresponds to correct elevation, and establishes the top level of the base pads 18. A string (not shown) is run between the stakes, and taking into account any adjustments necessary for line sag, the string sets the top level for all of the base pads 18 as well as the center line for each of the base pad 18.

The edge points of each panel 14 can then be marked, which will correspond to the center point of each base pad 18. An alignment stake is driven at each mark wherein the top level of the stake is level with the plumb line. With the thickness and over all dimensions of the base pads 18 known, grade can be adjusted to allow for uniform placement of the base pads 18. In order to facilitate this process a template can be used to mark the dimension of the base pads 18 to allow for easily making any adjustments to the grade to accommodate placement of the base pad.

Finally, the base pads 18 are arranged with the center alignment hole 58 placed over the alignment stake. This process will allow for uniform placement and alignment of the base pads 18 and subsequent placement of the panels 14 such that the base pads 18 are correctly placed with regard to each other and with respect to grade level.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

What is claimed is:

1. A skirting system for placement around a manufactured or modular home, said system comprising:

a plurality of panels with upper and lower ends, said panels having a frame comprised of a lower beam with an alignment tab and an upper beam with an alignment slot, and masonry construction therebetween, said panels adapted for abutting each other side to side to form a perimeter around the home;

a plurality of base pads adapted for placement on the ground for supporting said lower ends of said panels, wherein said base pads further comprise slots adapted for receipt of said alignment tabs of said lower beam of said panels;

a plurality of channel clips adapted for securing said upper ends of said panels to the home, said clips further comprising a front clip portion and a slotted clip portion, wherein said slotted clip portion comprises a vertical portion with an elongated slot and a horizontal portion, and said front clip portion comprises a vertical portion and a horizontal portion, and wherein said slotted and front clip portions are releasably joined together along said respective horizontal portions with screws that also adapted to be secured to the home; and anchor bolts for securing said slotted clip potion of said channel clips to said upper ends of said panels, wherein said anchor bolts are L-shaped and one end of said anchor bolts passes through said elongated slot of said slotted clip portion of said channel clip and the other end extends into said alignment slot of said upper beam of said panels.

2. The system in accordance with claim 1 further comprising a reinforcement rod connected to said upper and lower beams of at least one of said plurality of panels for structural support thereof.

3. The system in accordance with claim 2 wherein said reinforcement rod is a first rod and further comprising a second reinforcement rod connected to said upper and lower beams of at least one of said plurality of panels.

4. The system in accordance with claim 3 wherein said reinforcement rods are perimeterally located about said at least one panel and spaced apart from each other.

5. The system in accordance with claim 1 wherein said masonry is brick masonry.

6. The system in accordance with claim 1 wherein said masonry is stone masonry.

7. The system in accordance with claim 1 wherein said panels further comprise recesses in said masonry located about the abutting sides of said panels.

8. The system in accordance with claim 7 wherein said panels further comprise inserts located in said recesses for disguising a seam between panels.

9. The system in accordance with claim 8 wherein said inserts are masonry.

* * * * *